US005911557A

United States Patent [19]

Gammerler

[11] Patent Number: 5,911,557

[45] Date of Patent: Jun. 15, 1999

[54] PROCESS AND DEVICE FOR TAKING AN OBJECT UP AND TRANSFERRING IT FROM A FIRST STATION TO A SECOND

[76] Inventor: Hagen Gammerler, Ichoring 44, D-82057 Icking, Germany

[21] Appl. No.: 08/727,657

[22] PCT Filed: Feb. 7, 1996

[86] PCT No.: PCT/EP96/00512

§ 371 Date: Feb. 7, 1997

§ 102(e) Date: Feb. 7, 1997

[87] PCT Pub. No.: WO96/25355

PCT Pub. Date: Aug. 22, 1996

[30] Foreign Application Priority Data

Feb. 13, 1995 [DE] Germany ..... 195 04 686

[51] Int. Cl.[6] ..... B65H 31/00

[52] U.S. Cl. ..... 414/744.6; 414/744.8; 414/800

[58] Field of Search ..... 414/744.6, 744.8, 414/786, 800, 790.2

[56] References Cited

U.S. PATENT DOCUMENTS

| | | | |
|---|---|---|---|
| 3,085,501 | 4/1963 | Wimmer | 414/744.6 X |
| 4,383,788 | 5/1983 | Sylvander | 414/744.6 |
| 4,588,070 | 5/1986 | Smith | 198/468.3 |
| 4,787,810 | 11/1988 | Cawley et al. | 414/591 |
| 5,042,862 | 8/1991 | Tübke . | |

FOREIGN PATENT DOCUMENTS

| | | | |
|---|---|---|---|
| 0 096 398 | 12/1983 | European Pat. Off. | B65H 31/30 |
| 31 02 431 | 1/1982 | Germany | B65H 31/30 |
| 32 21 194 | 1/1983 | Germany | B65H 5/00 |
| 83 16 127 U1 | 11/1983 | Germany | B65H 31/30 |
| 33 24 349 | 11/1984 | Germany | B66F 9/12 |
| 40 32 854 | 4/1991 | Germany | B65H 31/30 |
| 91 03 498 U1 | 6/1991 | Germany | B65G 1/00 |
| 42 41 800 | 6/1994 | Germany | B65H 31/30 |
| 44 27 703 | 2/1996 | Germany . | |

*Primary Examiner*—Janice L. Krizek
*Attorney, Agent, or Firm*—Fitch, Even, Tabin & Flannery

[57] ABSTRACT

The invention relates to a process and device for taking up stacked or flat objects and subsequently transferring them from a collecting point forming a first station to a second station at which the objects are further processed or handled. The gripping device used is assisted by additional supports in the region not covered by the grip. This assistance occurs when the object is taken up from the first station and stops during the transfer to the second station. The additional supports may be mechanically, pneumatically or hydraulically controlled.

10 Claims, 8 Drawing Sheets

Figure 1:
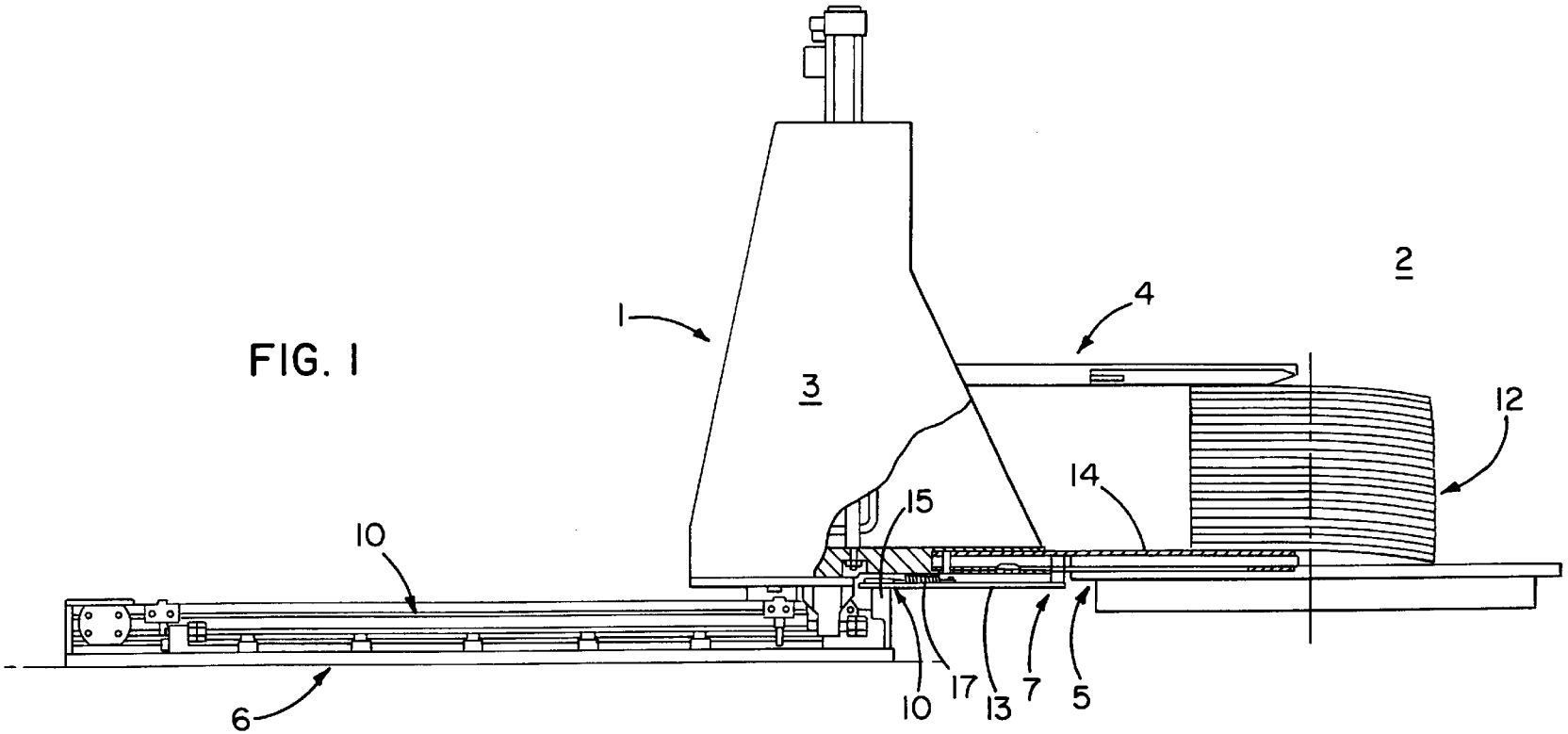

PROCESS AND DEVICE FOR TAKING AN OBJECT UP AND TRANSFERRING IT FROM A FIRST STATION TO A SECOND

The invention relates to an apparatus for the removal and transfer of an object, in particular a stack of layers placed above one another, in particular paper products, for example signatures, from a first station, for example a collecting location, to another station, a second station. The apparatus has a grasper device which has an upper and a lower grasper unit, with the grasper device being movable out of a first position in which it is located or in front of the collecting location, termed a first station in the following, and is movable, after movement out of the first station, and after a rotation, into a second position, i.e. in front of the second station.

In the grasper device described in the main application P 44 27 703.2 the grasper units of the grasper device are so dimensioned that they do not fully engage beneath and also above the object, in that case a stack of signatures, over the full length of signatures, but rather only up to the half of the signatures, in order to be able to later strap or bind up the stack in the second station while still in the grasper.

However, this has the consequence that the non-grasped region of the stack hangs downwardly despite the stabilisation measures, in particular with shallow stacks, and is exposed to the danger of damage.

The present invention is thus based on the object of setting forth a method by means of which the stack in general or an object of this kind can be brought as securely as possible from one station to a second one and to so further develop the apparatus of P 44 27 703.2 that a the hanging down of the non-grasped region of an object, for example layers placed above one another, in particular signatures, can be protected against the danger of damage on being removed from a first station and transferred to a second station.

The object is satisfied with respect to the method in that the grasper device draws the object, after it has grasped it, onto a support means during the return movement out of the collecting location, with the object remaining at rest on the support means during the rotation of the rotary table, and from which it is pushed down again on movement of the grasper device up to the processing location or deposition location.

In a variant of this method, during the inward movement of the grasper device, a support extension is extended, at least at the lower grasper unit, which extends the lower grasper unit towards the front, so that a greater support is offered to the object.

The support or the extension of the support is advantageously moved in again on the approach of the grasper device to the processing location, or to the setting down location of the second station, so that there the intended processing step, for example the banding can take place, without this banding being hindered by handling means.

With respect to the apparatus, the object is satisfied by support means arranged in the same plane as or fractionally beneath the lower grasper unit and on which the object is supported on being moved out of the first station after having been grasped.

The support means can advantageously be brought into and out of operation, with them forming an extension of the lower grasper unit in the operating mode.

It is advantageous in this respect that the support means can be controllably moved over a specific path substantially parallel to the lower grasper unit. In a preferred embodiment, the support means are arranged on the grasper device.

In this respect it can be advantageous that the support means are lockable in a predetermined position in relationship to the grasper device. The locking advantageously takes place at the rotary table. It is then advantageous when means are provided at the grasper device to release the locking of the support means.

The support means are advantageously guided on the lower grasper unit.

For this purpose, in accordance with a preferred embodiment, the lower grasper unit has longitudinally slotted tubes, or downwardly open U-section carriers, as grasper parts, with the support means formed as support rails being arranged in the latter.

The support rails are in this embodiment provided with a control hoop, the length of which corresponds substantially to the support length of the rails. A catch mechanism is arranged at the end of the control hoop towards the grasper device for the locking of the support rails.

A favourable embodiment provides that the catch mechanism is latched, on the one hand, with a cam arranged at the outer margin of the rotary table and, on the other hand, is released by a cam arranged in the front region of the grasper device. In this arrangement the catch of the catch mechanism is drawn by means of a spring into the latching position.

Provision is advantageously made for the support rails to persist in the released position relative to the grasper device under the control of friction.

In a favourable embodiment, the control hoop is substantially Ω-shaped, with the laterally directed limbs of the Ω each being fixed to one support rail and with the hoop of the Ω carrying the catch at its end region.

In this arrangement the cam of the rotary table travels during the forward movement of the grasper device into the Ω hoop and latches at the end of the hoop with the catch.

In an alternative embodiment, the support means are formed as a piston-in-cylinder arrangement.

In a next embodiment, provision is made for the support means to be controlled by a piston-in-cylinder arrangement or the like. In this way, the support means are extended to their full length on travelling beneath the object, whereas they are moved in again on approaching the processing position or setting down position in the second station and are fully moved in on reaching this end position.

In a further embodiment of the apparatus, the support means are formed as a support table or rail devices arranged on the rotary table and can be adjusted to be on the same plane as or fractionally lower than the object support plane.

The support means can then be adjustably arranged on the same plane or to be fractionally higher than the object support in the second station.

Figure 2:
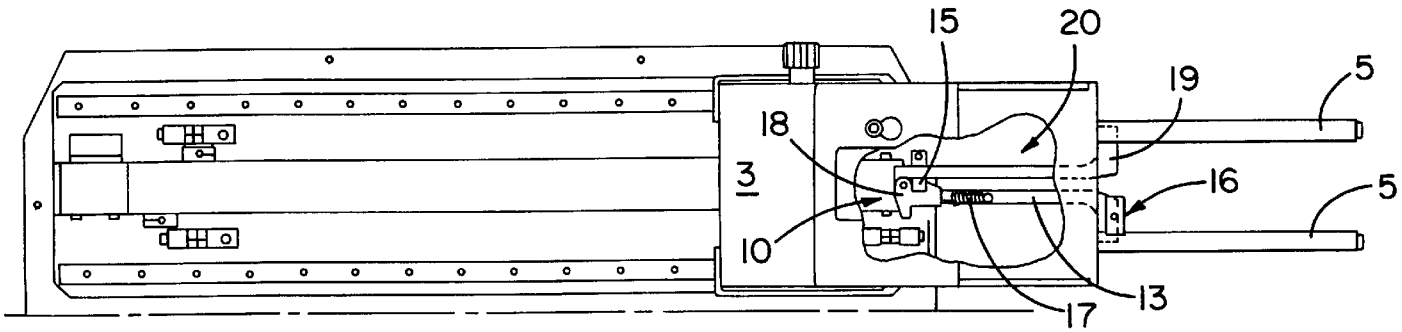
Figure 3:
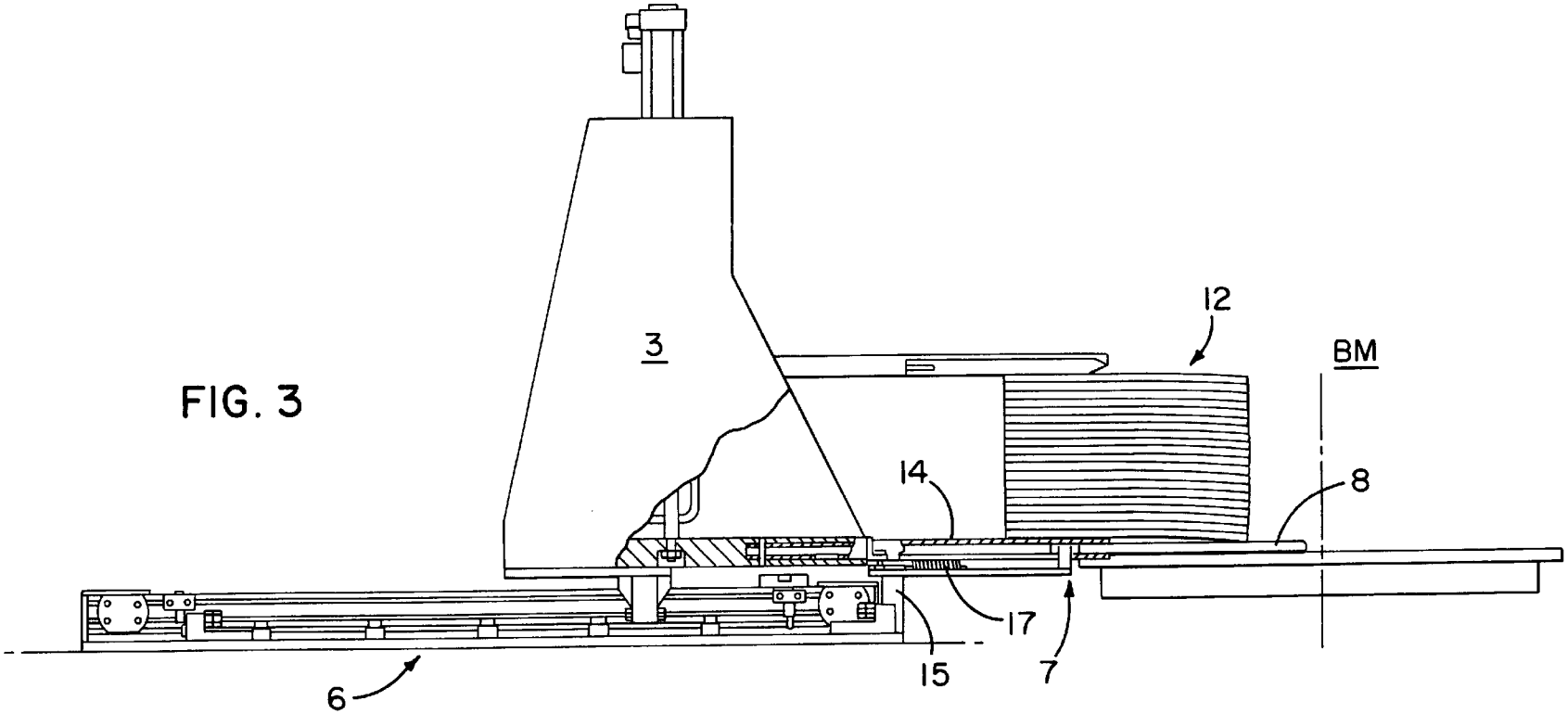
Figure 4:
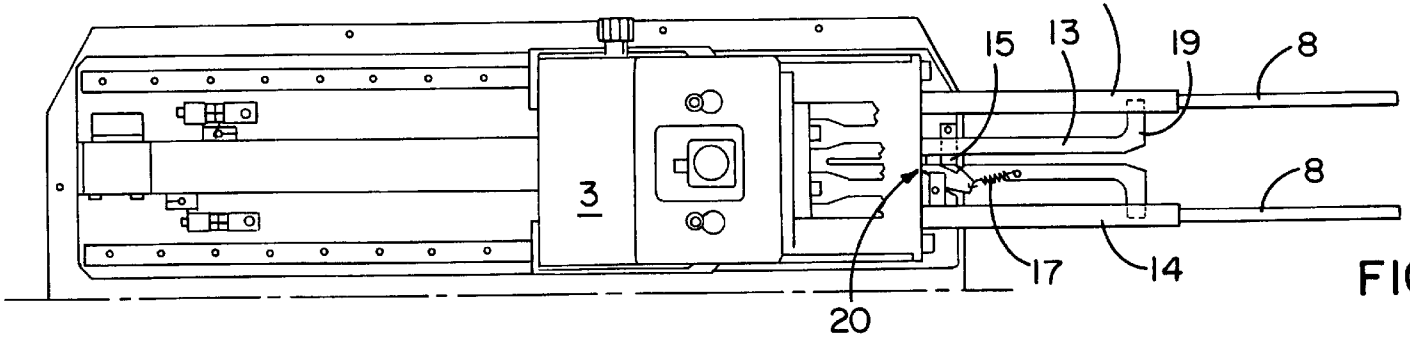
Figure 5:
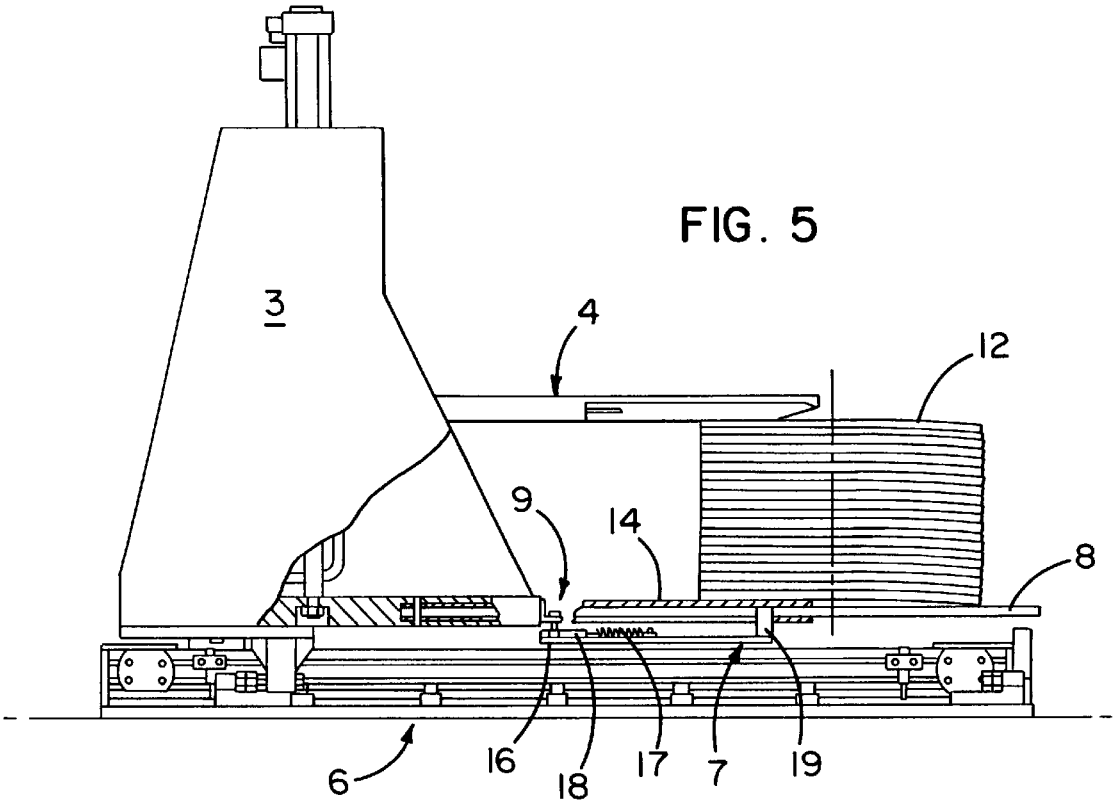
Figure 6:
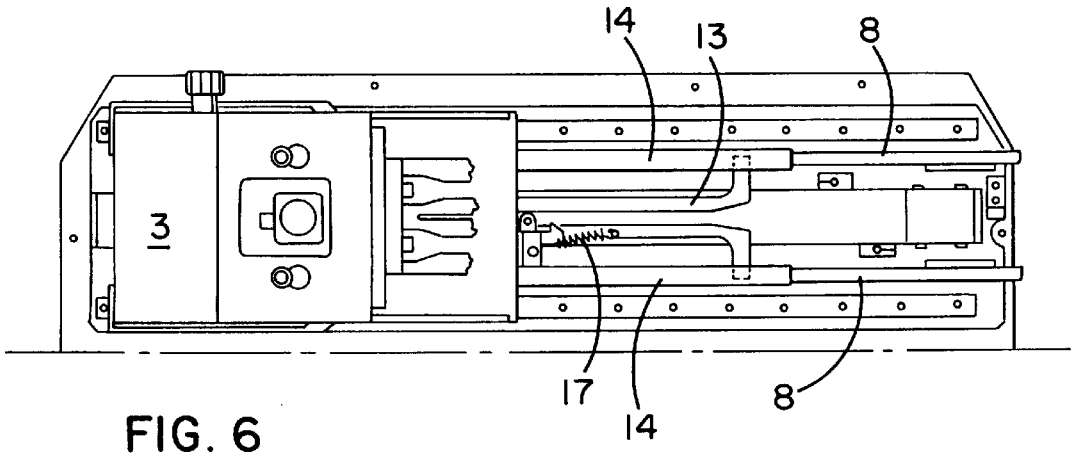
Figure 7:
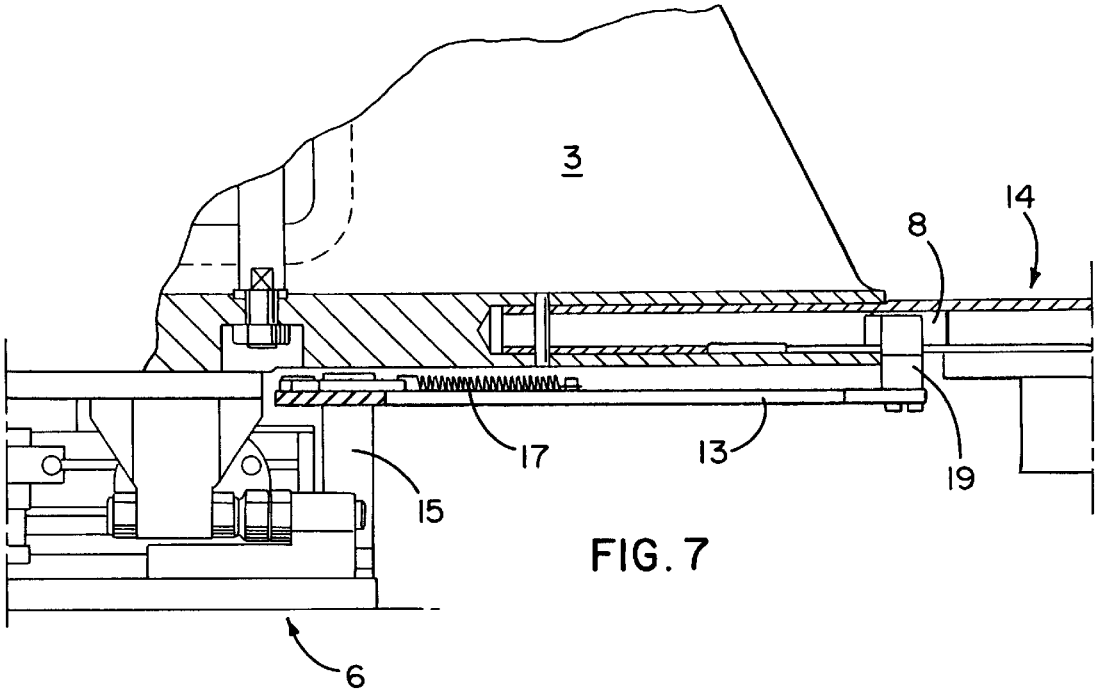
Figure 8:
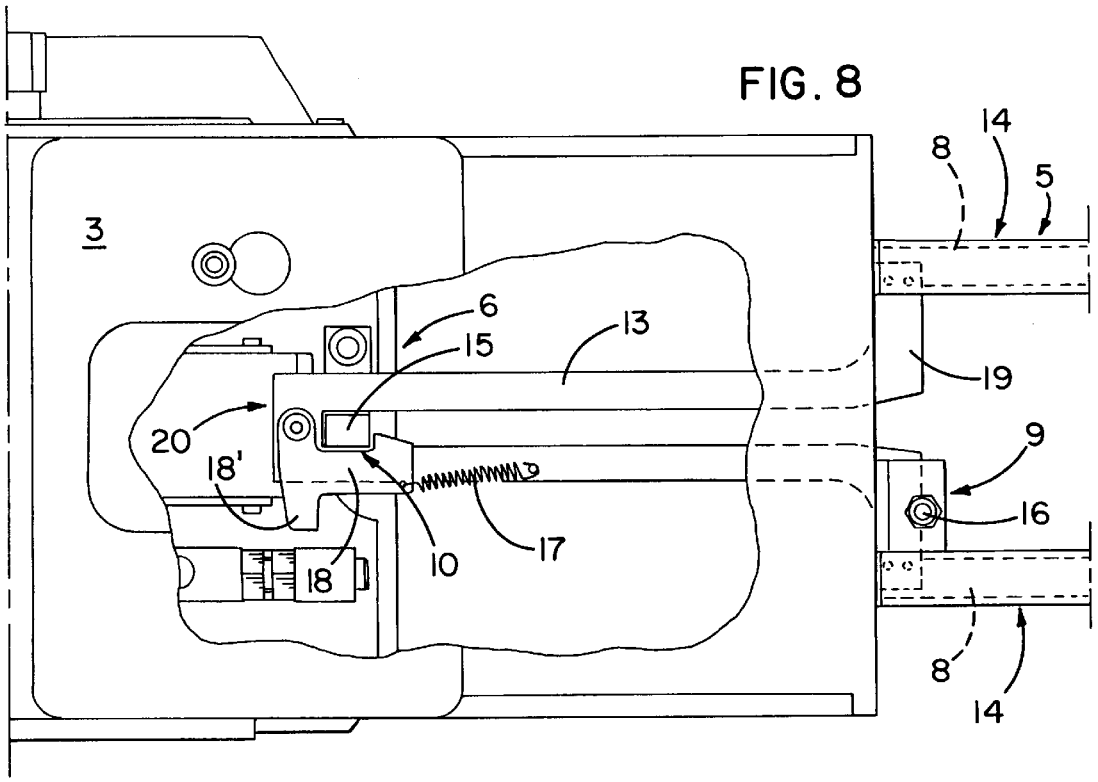
Figure 9:
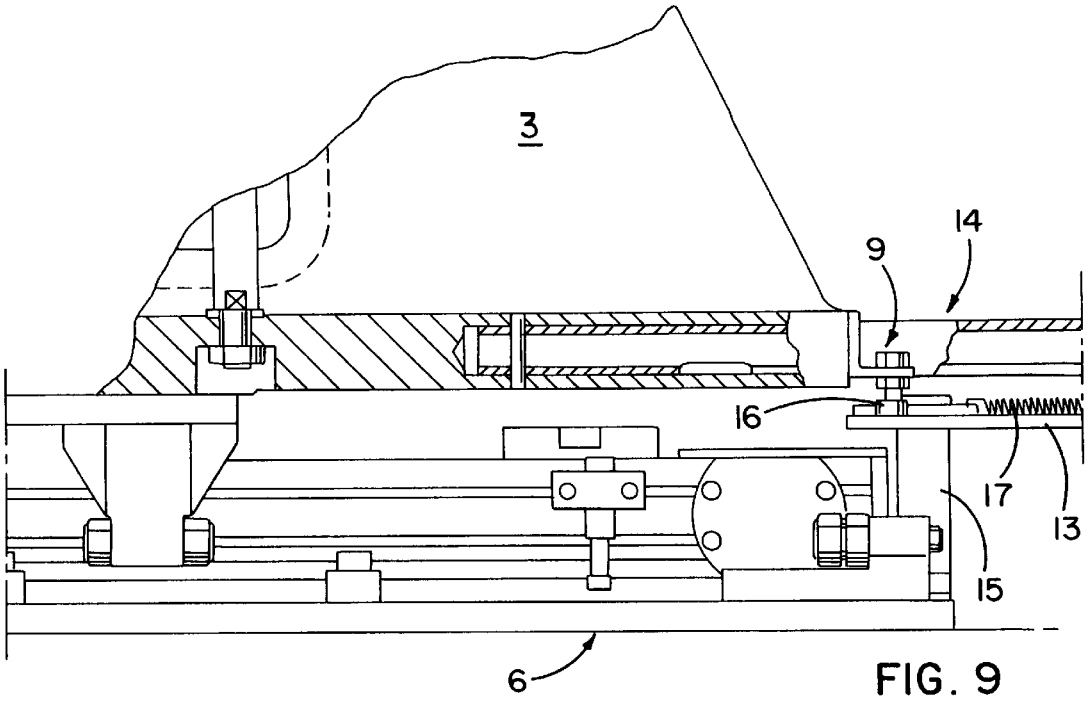
Figure 10:
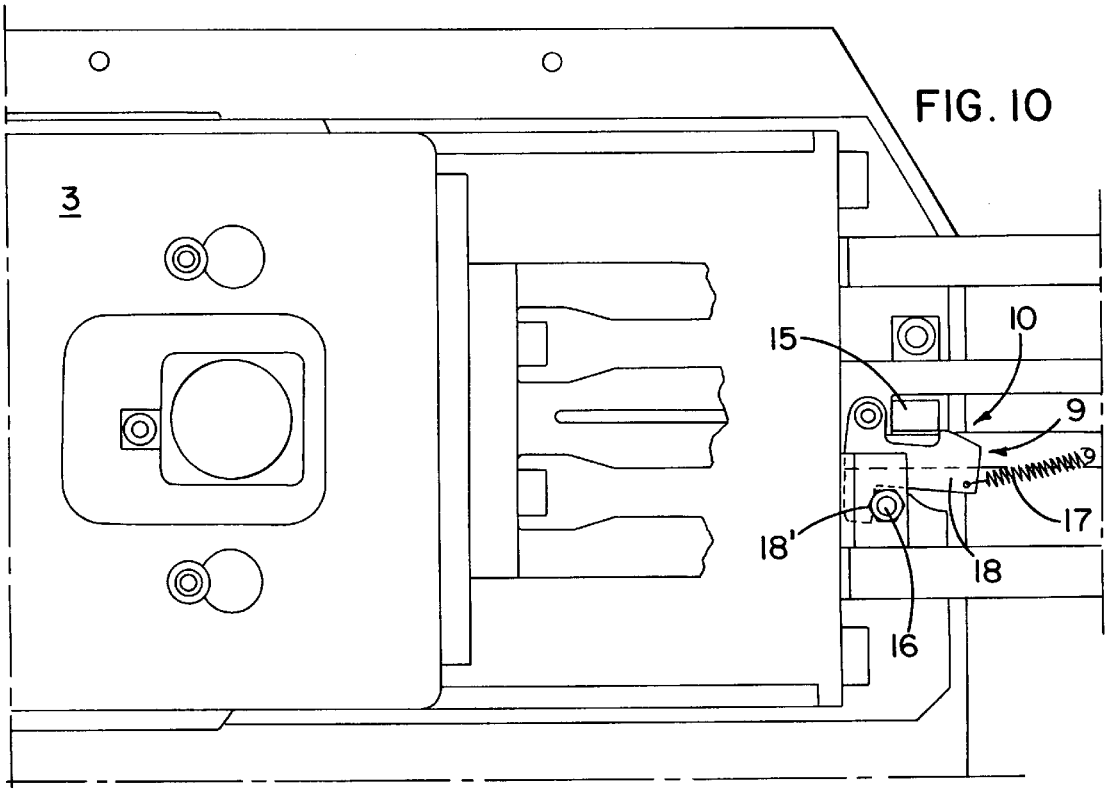
Figure 11:
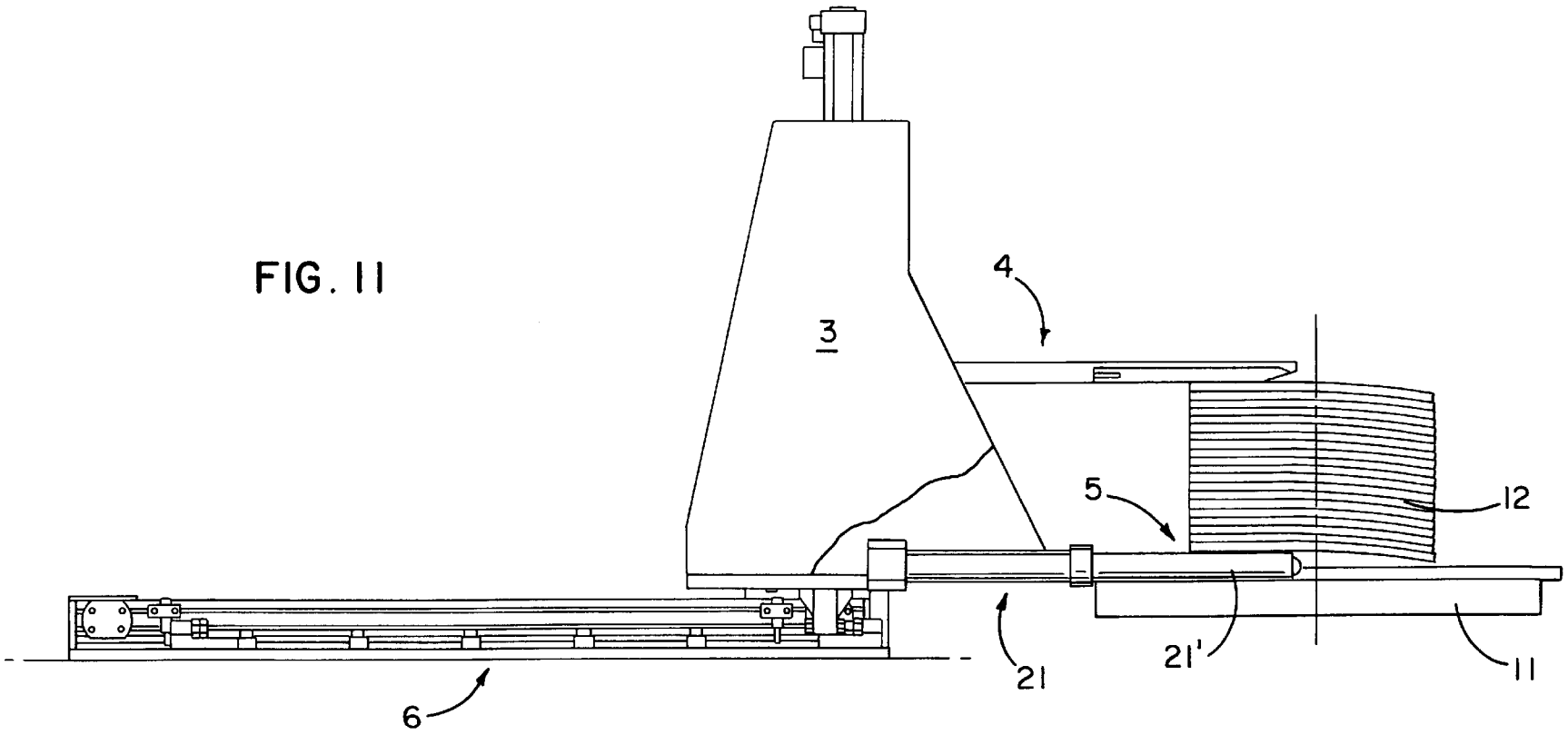
Figure 12:
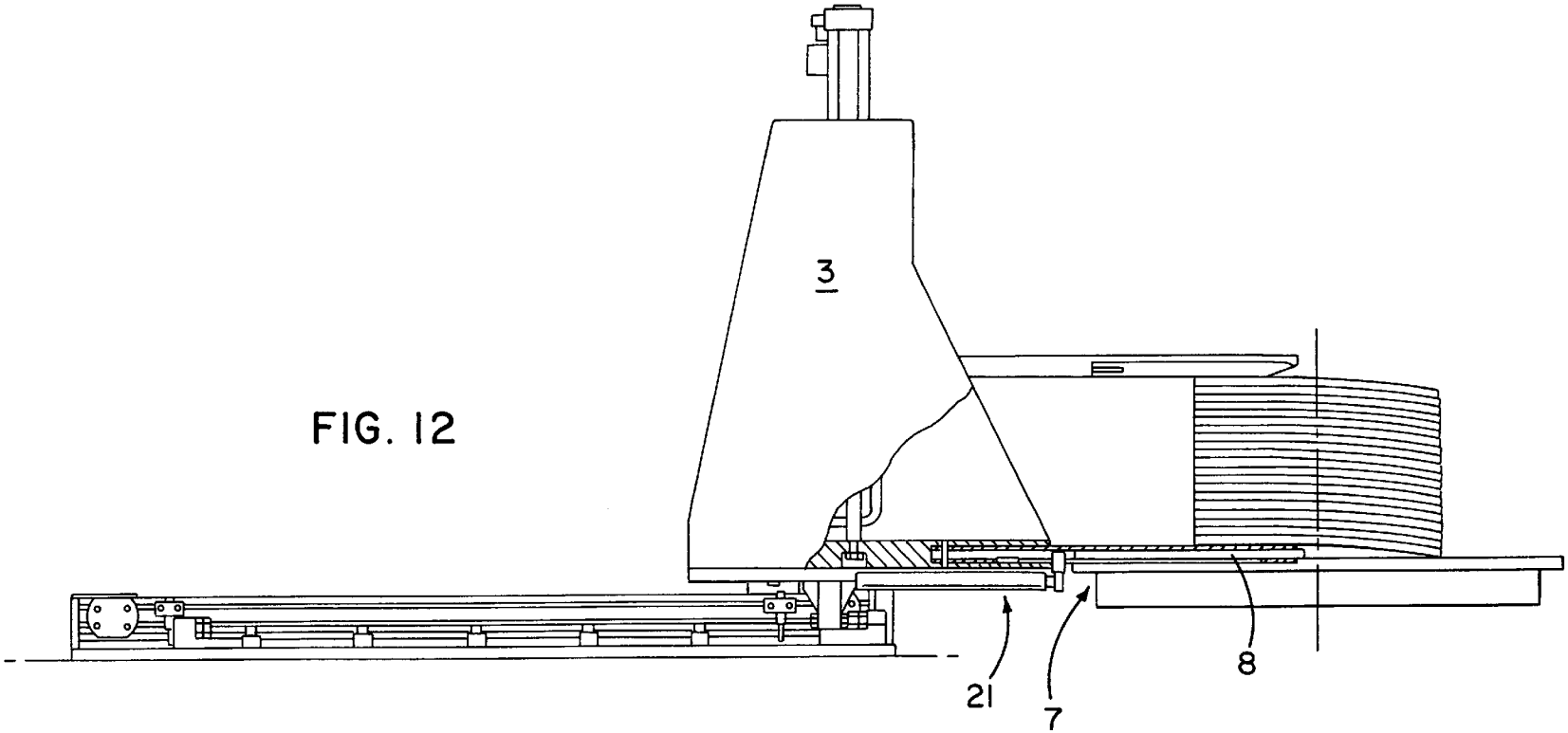
Figure 13:
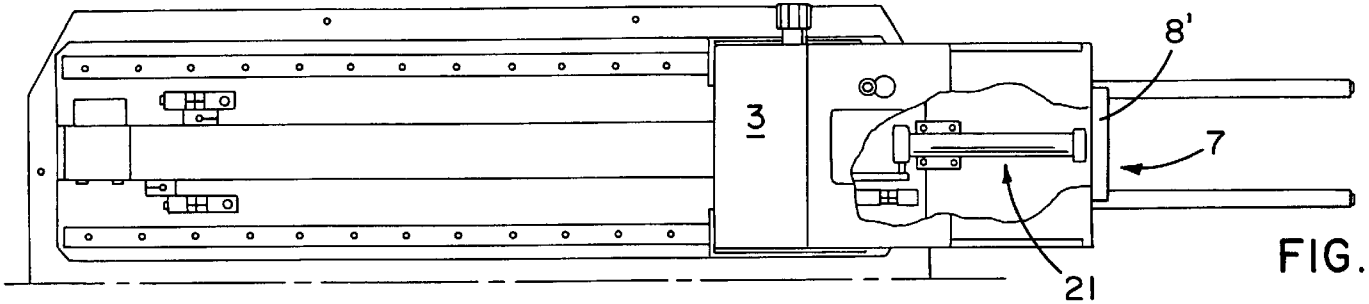
Figure 14:
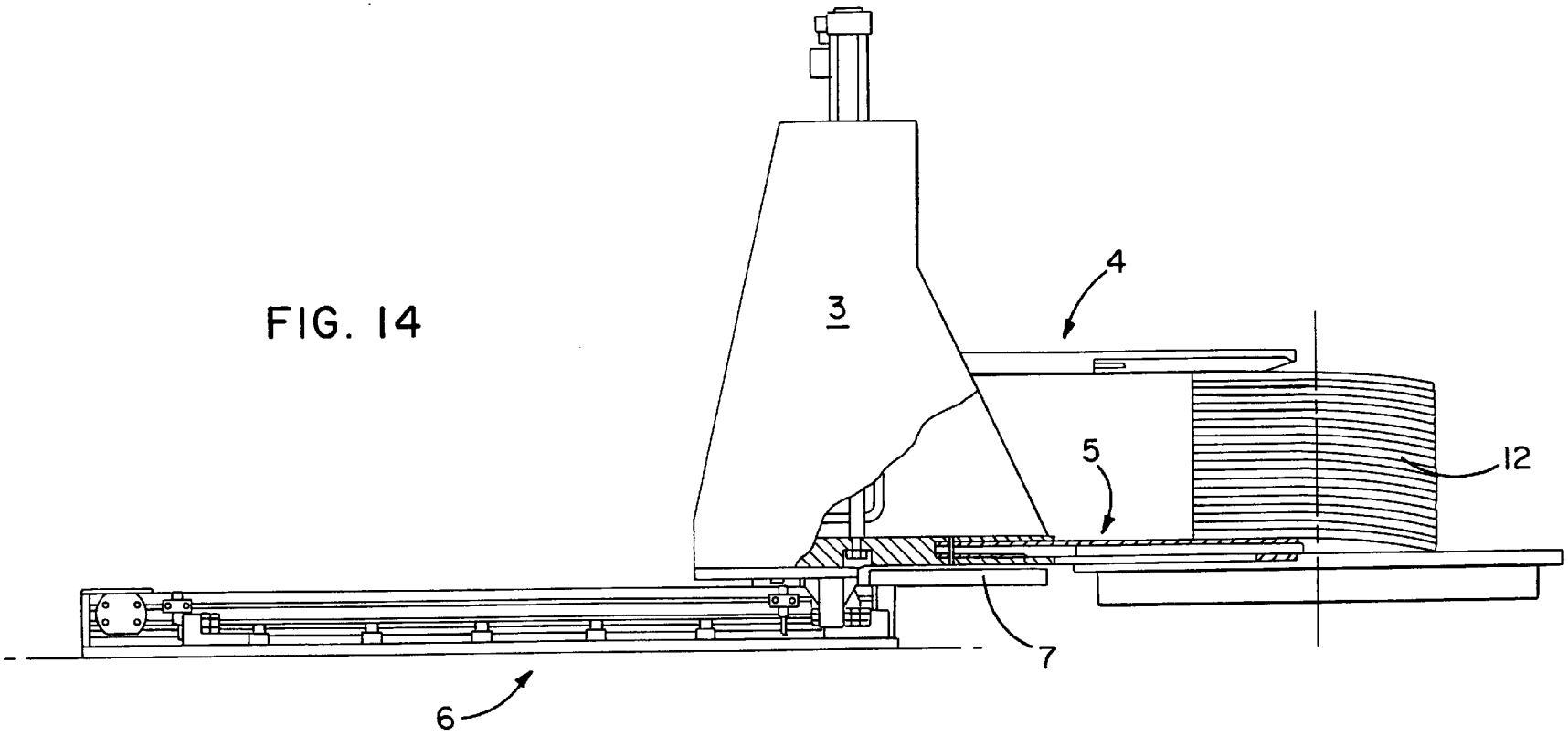

The invention will be described in more detail in the following with reference to embodiments shown in the drawings. There are shown:

FIG. 1 an apparatus in accordance with the invention with a grasper device and a collection position seen in side view, FIG. 2 a view of the apparatus of FIG. 1 from above, FIG. 3 a side view of the apparatus of FIG. 1 with a stack placed onto a support, FIG. 4 the apparatus in the position of FIG. 3 seen from above without a stack, FIG. 5 a view of the apparatus with the grasper device on the rotary table in the rotary position, FIG. 6 a view of the apparatus in the position of FIG. 5 from above, FIG. 7 a detailed view of the apparatus in the position of FIG. 1, FIG. 8 a view of the apparatus of FIG. 7 from above, FIG. 9 a view of the apparatus in the position of FIG. 3, FIG. 10 a view of the apparatus in the position of FIG. 9, FIG. 11 a further embodiment of the apparatus in a side view, FIG. 12 a next embodiment of the apparatus in a side view, FIG. 13 a view of an embodiment in accordance with FIG. 12 from above, and FIG. 14 a view of a further embodiment in side view.

An apparatus for removing and transferring a stack 12 from a collecting location 2 in a stacking device is shown in FIGS. 1 to 10. The collecting location 2 is described as station 1 in the further course of the description.

The apparatus removes the stack from the station 1 and transfers it in accordance with the method, which will be explained later in more detail, to a second station (not shown) which can be a banding station or any other desired processing station or handling station.

The overall apparatus in accordance with the patent application P 44 27 703.2 has two grasper devices 3 arranged on a rotary table of which only one is shown in FIG. 1. These two grasper devices operate alternately in a cycle. The grasper device 3 has two grasper units 4 and 5 which can be bar-like components. Depending on the embodiment, both the upper and also the lower grasper unit 4 and 5 respectively, or simply the upper grasper unit 4, can be made vertically movable for the purpose of grasping and pressing the object together. In the illustrated embodiment at least the upper grasper unit 4 is vertically movable.

The grasper unit is movable forwardly and rearwardly on the rotary table 6 on a rail arrangement.

The lower grasper unit is equipped with a support means 7 which is arranged on the same plane as or fractionally beneath the plane of the lower grasper unit. After the gripping of the object, this is drawn onto the support during the movement out of the first station.

The support means 7 only enters into operation in the illustrated embodiment when the grasper units are moving out of the first station. Then the support means form an extension for the lower grasper unit 5.

Once the full support surface has entered into operation, the support means are controllably movable parallel to the grasper unit over a predetermined path. The path is restricted by the length of the rails for the grasper device 3 on the rotary table.

In the embodiment shown in FIGS. 1 to 10, the support means are arranged on the grasper device 3. In order that the object, i.e. the stack 12, can be loaded onto the support means 7 while the grasper device moves rearwardly, the support means can be locked into a predetermined position in relation to the grasper device 3 (see FIGS. 3, 4, 7 and 8). If the object is now correctly arranged on the support means, then the support means is released relative to the grasper device 3 and travels back together with the grasper device over the aforesaid predetermined path on the rotary table, so that the rotary table can execute its predetermined rotation (see FIG. 5) in the further course of the handling operation.

In the embodiment shown in FIGS. 1 to 10, the lower grasper unit 5 has longitudinally slotted tubular or U-section beams 14 as grasper parts (see FIG. 7). The support means, which are formed in this embodiment as support rails 8, are received and guided in the slotted tube or in the U-section beams 14.

In the following, reference will in particular be made to FIGS. 7 and 8. The support rails are secured at their ends respectively adjacent the grasper device to a control hoop 13. The control hoop 13 has essentially the shape of the Greek letter omega Ω, the side limbs 19 of which are each rigidly connected with one support rail 8. The hoop 20 of the Ω extends in elongate manner in the direction of the grasper device parallel to the longitudinal axis of the support rails 8 and carries at its hoop-like end a catch mechanism 10. The catch mechanism 10 has a catch 18 which is drawn by means of a spring 17 into the latching position (FIG. 8). A cam 15 is arranged on the rotary table 6, and the catch 18 is latched with the cam when the grasper device 3 is located in its frontmost end position. In this position, the lower grasper unit 5 engages beneath the object in the collecting location 2. Means 9 for releasing the catch mechanism 10 are provided in the front region of the grasper device 3 between the tubular bars of the lower grasper unit 5. These means for releasing consist of a downwardly directed cam 16 which can engage with a hook 18' of the catch 18 in such a way that the latching of the catch 18 with the cam 15 of the rotary table 6 is released (FIGS. 9, 10).

In the following, the function of the apparatus and the method which is used by the apparatus will be explained in more detail.

The apparatus is suitable for grasping and transferring an object, for example layers of paper, sheet metal or the like, placed above one another from a collecting location in which these layers are ordered together to form a stack, to a second processing or handling station. The method is to be described in connection with a collecting location for printed products, in particular signatures, which is formed as a cross-stacker. After the desired number of cross-stacked stacks has been achieved in the cross-stacker, the grasper device 3 moves with the grasper units 4, 5 open into the collecting location 2, or into the cross-stacker and the upper gripper unit engages above the uppermost layer of the stack, whereas the lower gripper unit 5 engages beneath the stack. For this purpose, the collecting table of the cross-stacker is formed with corresponding grooves or comparable means so that the lower grasper unit which is formed as a bar arrangement extending parallel to one another can be moved without hindrance beneath the stack. The collected and cross-stacked signatures are banded around for transport in the present example of use in a next working step in a second station. The banding advantageously takes place at a point in time at which the stack is still held by the grasper units in a pressed-together state. For this reason, the grasper units are not permitted to project into the region in which the banding takes place. As a rule, the grasper units thus only grasp the stack in a region which ends shortly before the middle of the stack. As already initially described it can transpire that only an inadequate support of the stack is hereby achieved with certain products so that damage to the stack can occur during the transport from the collecting location to the next processing station. Here, the invention provides assistance.

After the grasper units 4, 5 have gripped the stack 12, it can be raised by a predetermined amount with the grasper device 3 travelling backwards simultaneously or directly thereafter and drawing the stack out of the collecting location. With certain products lifting is not necessary. Here, the lower grasper unit is provided with a run-up ramp which somewhat lifts the stack on being moved beneath it. If the grasper units 4 and 5 reach their lowermost position in the collecting location, then the support means 7, in the present case the support rails 8, are latched by means of the catch mechanism 10 at the cam 15 of the rotary table. While the grasper device 3 now moves rearwardly on the rails of the rotary table, the support means 7 remain stationary relative to the grasper device since they are latched to the rotary table, so that the stack 12 can be drawn onto the support means during the rearward movement of the grasper device (FIG. 3).

In the examples shown in FIGS. 1 to 10, the support means are arranged as support rails in the bars 14 of the lower grasper unit 5 which are formed as tubes. During the return movement of the grasper device the support rails are increasingly exposed and quasi push themselves beneath the stack 12 which is moved to the left in FIG. 1. After a predetermined path, the whole remainder of the stack beneath which the grasper unit 5 does not engage lies on the support means 7 or on the support rails 8 (FIG. 3). At this point in time, the latching of the support means with the rotary table 6 is released and the support means 7 travel further backwards together with the grasper device 3 on the rotary table 6 up to an end abutment at which the grasper device 3 comes to a stop (FIG. 5). During this further return movement, the means 9 for releasing the locking, which consists of a downwardly projecting cam 16 arranged in the front region of the grasper device 3, continues to remain in engagement with the catch 18 of the catch mechanism 10 (FIG. 10). After reaching the end position of the grasper device 3, the rotary table rotates in order to bring the grasper device 3 and thus the stack 12 into position relative to a second station in which the next handling step, for example the banding, is to take place. The grasper device 3 now moves forwardly, with the support means 7 remaining in its position relative to the grasper device 3 as a result of a controlled friction in the guidance of the tubes 14 and also at the control hoop 13.

Reference can now again be made to FIGS. 3 and 4 with the assumption that one is now concerned with the station 2. The stack 12 has not yet reached its rest or processing position, the catch mechanism 10 at the end of the arc 20 of the control hoop 13 however again enters into engagement at this time with the cam 15 of the rotary table 6. In this manner, the support means 15 is locked, whereas the grasper device 3, and thus also the stack 12, moves further in the direction towards the processing position. In FIG. 3 it can clearly be recognised that the end of the support rails 8 has come to a stop at a distance from the processing centre line BM. On further moving in of the grasper device 3, the stack 12 is pushed over the support rails 8 and achieves its end position in this manner, as can, for example, be recognised by analogous consideration of FIG. 1.

In this position the next processing step, for example the banding, can take place directly after reaching this position, with the grasper device being released shortly after the start of this processing step by movement of the upper and/or lower grasper units 4, 5 apart from one another. The grasper device 3 then moves out of the station 2 with the same mechanical series of events taking place with respect to the support means 7 as described during the movement out of the first station. This signifies that with renewed movement of the grasper device 3 into the collecting location of the cross-stacker the support rails first move beneath the stack 12 and that in the further course of the movement of the grasper device 3 the tubes 14 are pushed over the support rails. If the grasper device 3 has reached its end position in the collecting location 2 then the process of removal takes place anew in the described manner.

With some devices the lower grasper unit is not vertically movable, as mentioned above, it is however provided with a run-up ramp in the front region, so that it can be straightforwardly pushed beneath the stack in the collecting location. If the lower grasper unit is however also vertically displaceable, then it can, during opening, i.e. during the downward movement, bring the cam of the rotary table out of engagement with the catch 18 after a predetermined path. The latching can then first take place again after a lifting of the lower grasper unit.

In an alternative embodiment illustrated in FIG. 11, the support means consists of a piston-in-cylinder arrangement 21, 21', with the piston 21' being formed as the support. The piston-in-cylinder arrangement is then controlled in accordance with the previously mentioned embodiment in correspondence with the inward and outward movement of the grasper device. In this embodiment, the catch mechanism is absent; however, a corresponding valve control is necessary in order to ensure that the support means enters into operation at the respectively desired points in time.

In the embodiment shown in FIG. 12 the control of the support means 7, in the present case of the support rails 8, takes place via a piston-in-cylinder arrangement 21. The mechanical control of the support means is replaced by this piston-in-cylinder arrangement 21, with a corresponding control sequence controlling the time sequence of the operation of the support means, here the support rails 8.

In FIG. 13 the embodiment illustrated in FIG. 12 is shown in plan view. A cross-beam 8' is provided between the two support rails 8 and connects the two rails together. The piston of the piston-in-cylinder arrangement 21 acts on this cross-beam 8' and is in turn secured to the grasper device 3.

In a particularly simple embodiment, such as is shown in FIG. 14, the support means 7 consists of a rigid plate or rail arrangement secured to the rotary table 6 This plate or rail arrangement extends directly up to the collecting table of the station 1 and also to the setting down table of the station 2, with this requiring a special constructional adaptation of the stations and also of the rotary table. After the object 12 has been grasped, it is simply drawn out of the collecting location onto the support 7 and remains there during the rotation, held by the grasper device 3.

After the rotation, the grasper device moves into the second collecting station and in this manner pushes the object 12 into the second station. In order to achieve smooth operation of the thrust and traction movement, it is necessary that the plane of the support 7 is the same as or preferably lies fractionally beneath the plane of the collecting table of the station 1, on the other hand, however, that the support 7 is the same as or preferably fractionally higher than the plane of the support of station 2.

The apparatus and the method are not restricted to the illustrated and described embodiments. Thus, a control of the support means by an electrically controlled positioning drive is, for example, not shown. It does, however, fall within the scope of protection of the claims in the same manner as means which are necessary to pneumatically or hydraulically operate the described piston-in-cylinder arrangements. The scope of use of the invention is also not restricted to the handling of signatures in a stacked form. Applications within the range of handling of desired areal structures can fall within the scope of protection in the same manner with corresponding adaptations of the elements forming the invention.

I claim:

1. A method of transferring stacks of products with a product stack grasper device on a rotary table for subjecting the transferred stack to processing, the method comprising:

advancing the grasper device toward the product stack to be gripped with first and second product grasping units of the grasper device;

gripping the product stack between the first and second grasping units so that a portion of the product stack extends beyond the grasping units;

retracting the grasper device to pull the gripped product stack with the grasping units;

shifting a support underneath the portion of the product stack extending beyond the grasper units as the grasper device is retracted so that full support for the entire product stack with the product stack portion being progressively pulled onto the support by the grasper units is provided;

moving the fully supported product stack towards a processing station;

advancing the grasper device to push the gripped product stack with the grasping units; and shifting the support from underneath the product stack to expose the portion of the product stack extending beyond the grasper units as the grasper device is advanced to allow for processing of the product stack while the stack is gripped between the grasping units.

2. The method of claim 1 wherein the products are signatures, and including binding the signature stack gripped between the grasper units about the portion of the stack extending beyond the grasping units after the grasper device has been advanced to shift the stack portion off from the support.

3. The method of claim 1 including moving the grasping units transverse to the advancing and retracting directions of movement of the grasper device so that the units are in spaced relation to the products in the stack before the units are brought into engagement with the stack to grip the stack therebetween.

4. The method of claim 1 wherein the fully supported product stack is moved towards the processing station by rotation of said rotary table to which the grasper device is mounted.

5. An apparatus for gripping an object across less than the entire extent of the object so that a portion thereof is unsupported for subjecting the object to processing at the unsupported portion thereof while the object is gripped, the apparatus comprising:

a rotary table, a grasping device on said rotary table having first and second grasping units and movable on the table towards an object processing location and an object collecting location, the object collecting location having the object thereat for being gripped, the grasping units gripping the object so that a portion of the object extends beyond the grasping units, the grasping device moving away from the collecting location with a gripped object; and a support distinct from the grasping units and having (1) a supporting mode where the portion of the object beyond the grasping units is shifted onto the support as an incident of moving the grasping device away from the collecting location with the object gripped between the units, and (2) a non-supporting mode where the portion of the object is shifted off from the support as an incident of moving the grasping device towards the processing location for unencumbered processing of the object at the unsupported portion thereof while the object is gripped between the units.

6. The apparatus of claim 5 wherein the object includes a stack of signatures and the grasping units include upper and lower units for gripping on the top and bottom of the signature stack, and the lower grasping unit has an interior with the support disposed in the interior in its non-supporting mode and extending beyond the lower unit interior in the supporting mode.

7. The apparatus of claim 5 wherein said grasping device is mounted on said rotary table for linear movement in advancing and retracting directions so that the grasping device is advanced towards the object collecting location, retracted therefrom with the object gripped by the grasping units and the portion thereof shifted onto the support, rotated by rotation of the rotary table into alignment with the processing location with the portion of the object on the support and advanced towards the processing location with the object portion shifted off the support for processing the object at the unsupported portion thereof.

8. The apparatus of claim 5 wherein the support is associated with one of the grasping units and is movable relative to the grasping device and associated unit thereof for a portion of the grasping device movement, and the support is fixed relative to the associated grasping unit during the remainder of the grasping device movement.

9. An apparatus for grasping an object, in particular a stack of paper products placed above one another, comprising a gripper device having upper and lower gripper units for gripping the object, the gripper device being arranged on a rotary table and horizontally movable in advancing and returning movements relative to the rotary table, at least one of the upper and lower gripper units being vertically movable, a support means on which the object becomes supported after being gripped by the units during the returning movement of the gripper device, the support means being arranged in the same plane as or fractionally beneath the lower gripper unit, the lower gripper unit comprising one of longitudinally slit tubes and U-section beams for gripping the object, and the support means including support rails that are arranged within said tubes or beams.

10. An apparatus for grasping an object, in particular a stack of paper products placed above one another, comprising a gripper device having upper and lower gripper units for gripping the object, the gripper device being arranged on a rotary table and horizontally movable in advancing and returning movements relative to the rotary table, at least one of the upper and lower gripper units being vertically movable, a support means on which the object becomes supported after being gripped by the units during the returning movement of the gripper device, the support means being arranged in the same plane as or fractionally beneath the lower gripper unit, and the support means formed by piston rods of a piston-in-cylinder arrangement.

* * * * *